US005273095A

United States Patent [19]

Lukos

[11] Patent Number: 5,273,095

[45] Date of Patent: Dec. 28, 1993

[54] ARM STRUCTURE FOR AWNING SUPPORT SYSTEM

[76] Inventor: Stephen P. Lukos, 1879 Litchfield Rd., Watertown, Conn. 06795

[21] Appl. No.: 895,671

[22] Filed: Jun. 9, 1992

Related U.S. Application Data

[63] Continuation-in-part of Ser. No. 673,189, Mar. 21, 1991, Pat. No. 5,119,867.

[51] Int. Cl.[5] ..... E04F 10/06

[52] U.S. Cl. ..... 160/70; 160/79

[58] Field of Search ..... 160/66, 67, 69, 70, 160/78, 79, 22; 135/89; 248/611, 273

[56] References Cited

U.S. PATENT DOCUMENTS

| | | | |
|---|---|---|---|
| 1,021,330 | 3/1912 | Price | 160/78 X |
| 1,759,715 | 5/1930 | Schane | 160/70 |
| 1,796,419 | 3/1931 | Anton | 248/273 |
| 1,842,402 | 1/1932 | Heiser | 160/70 |
| 1,856,161 | 5/1932 | Heiser | 160/70 |
| 1,897,029 | 2/1933 | Bell et al. | 160/70 |
| 1,915,529 | 6/1933 | Heiser | 160/70 |
| 2,321,801 | 6/1943 | Dazzo | 160/69 |
| 4,214,621 | 7/1980 | Wessels et al. | 160/66 |
| 4,495,977 | 1/1985 | Delluc | 160/66 X |

FOREIGN PATENT DOCUMENTS

| | | | |
|---|---|---|---|
| 3625604 | 2/1988 | Fed. Rep. of Germany | 160/67 |
| 483001 | 4/1938 | United Kingdom | 160/70 |

*Primary Examiner*—David M. Purol

*Attorney, Agent, or Firm*—John H. Crozier

[57] ABSTRACT

In a preferred embodiment, a bracket assembly for a lateral arm of an awning support system, the bracket assembly including: a bracket mount to mount said bracket assembly to a surface from which the awning extends; an arm mount for the vertically pivotal attachment to the bracket mount of the proximal end of the lateral arm; and a spring operatively connected between the bracket mount and the arm mount to normally maintain the lateral arm in an equilibrium position, but to allow the lateral arm to rotate vertically from the equilibrium position to absorb the vertical component of an excessive load on the awning and/or to permit the awning to shed the condition producing the excessive load.

11 Claims, 5 Drawing Sheets

ARM STRUCTURE FOR AWNING SUPPORT SYSTEM

CROSS-REFERENCE TO RELATED APPLICATION

This application is a continuation-in-part of copending application Ser. No. 07/673,189, filed Mar. 21, 1991, now U.S. Pat. No. 5,119,867.

BACKGROUND OF THE INVENTION

1. Field of the Invention

The present invention relates to awning support systems generally and, more particularly, but not by way of limitation, to a novel awning support system which permits the lateral arms of such a system to flex vertically to absorb the vertical component of an excessive load and/or to shed the condition causing the excessive load.

2. Background Art

Awning support systems generally have at least two lateral arms which are mounted at one end by brackets to the wall or frame of a building and which are joined at the opposite end to one or more cross ribs so as to create a support for stretching and holding an awning cover thereon. Variations of such awning support systems are those with horizontally extendable lateral arms, arms which are collapsible downwardly, or arms which fold accordion-style.

In all such known awing support systems, the lateral arms are rigidly held in fixed position at the wall mounting when the awning is in use and, particularly, the lateral arms are held against any vertical motion. This rigidity of the lateral arms has the substantial problem that serious damage can occur to the arm structure if an excessive load is placed on the awning, such as from excessive pressure of snow, rain, or wind thereon. Such pressure translates to a large moment arm about the mounting bracket which is a typical point of failure.

Accordingly, it is a principal object of the present invention to provide an awning support system which has means for preventing damage to arm structures when the awning is subjected to excessive loads.

It is a further object of the invention to provide such an awning support system that permits the lateral arms thereof to flex vertically in response to excessive loads.

It is an additional object of the invention to provide such an awning support system that is easily and economically manufactured.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a bracket assembly for a lateral arm of an awning support system, comprising: bracket mounting means to mount said bracket assembly to a surface from which said awning extends; arm mounting means for the vertically pivotal attachment to said bracket mounting means of the proximal end of said lateral arm; and spring means operatively connected between said bracket mounting means and said arm mounting means to normally maintain said lateral arm in an equilibrium position, but to allow said lateral arm to rotate vertically from said equilibrium position to absorb the vertical component of an excessive load on said awning and/or to permit said awning to shed the condition producing said excessive load.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
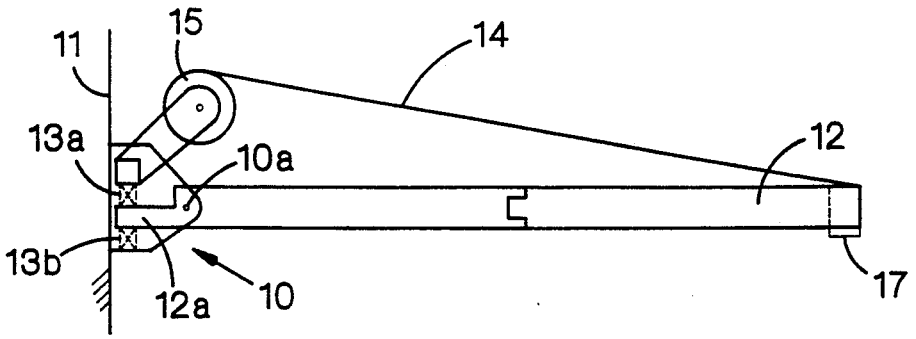
FIGS. 1–3 are schematic side elevational views of an awning support system including one type of lateral arm bracket according to the present invention.

Referring now to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIGS. 1–4 illustrate an awning support system which includes mounting brackets, generally indicated by the reference numeral 10, according to one embodiment of the present invention. Brackets 10 are mounted to a wall 11 of a building (not otherwise shown) by means such as suitable screws or anchor bolts and a pair of lateral support arms 12 (FIG. 4) having proximal ends 12*a* which are pivotally mounted to the brackets at pivot mounting points 10*a*. Each proximal end 12*a* is compressibly held between a pair of compression springs 13*a* and 13*b* which are pre-selected and tensioned so as to hold the lateral arms 12 in an extended horizontal, or other, equilibrium position under normal loading conditions.

Figure 2:
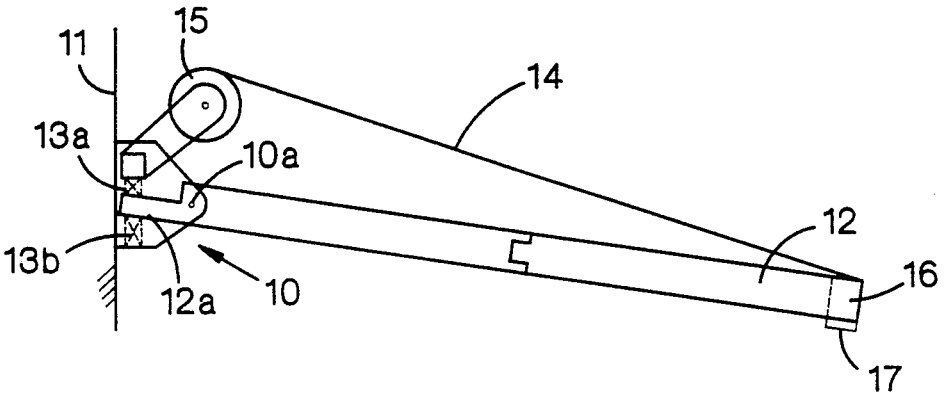
Figure 3:
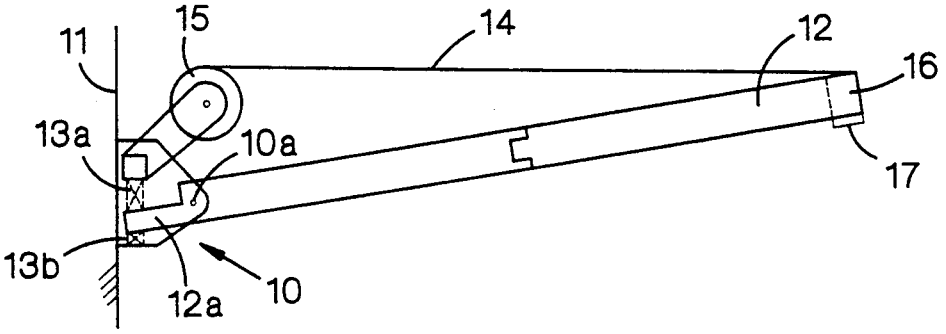
Figure 4:
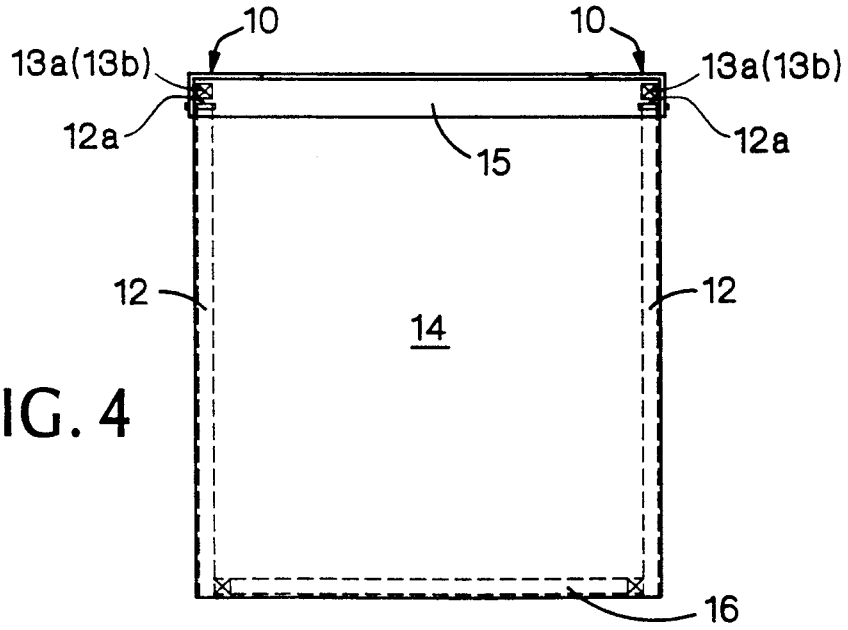
FIG. 4 is a top plan view of the awning support system of FIG. 1–3.

With the load absorbing features of mounting brackets 10, lateral arms 12 are able to flex downwardly (FIG. 2) or upwardly (FIG. 3) in order to absorb and/or shed the vertical component of a potentially damaging load applied on the awning, such as snow or water or the vertical component (up or down) of a wind load. Water or snow that pooled or accumulated on the upper surface of cover 14 would be discharged as the awning were deflected downwardly (FIG. 2). Similarly, lateral arms 12 would yield flexibly under a heavy load applied suddenly to the lateral arms, such as a vandal grabbing onto the end of the awning. When the excessive load is removed, compression springs 13*a* and 13*b* return lateral arms 12 to their equilibrium position. This load absorbing and/or shedding capability greatly reduces the likelihood that an excessive load will cause damage to lateral arms 12 or cover 14 or cause mountings 10 to be pulled out of the wall.

Springs 13*a* and 13*b* can be compression or extension coil type. Lateral arms 12 can be of any desired construction, such as straight tubing, telescoping tubing, downwardly folding, or retractable type. The tubing construction of lateral arms 12 can be designed to accommodate stress also, such as by providing flexibility, lighter weight members at the distal ends of the arms, and/or interior dampers.

Awning cover 14 may be made of fabric and is wound on a reel 15 rotatably mounted to brackets 10. The fabric can be any material that serves as a cover, such as, for example, vinyl or plastic; however, it is preferred that the material be weatherproof.

Figure 5:
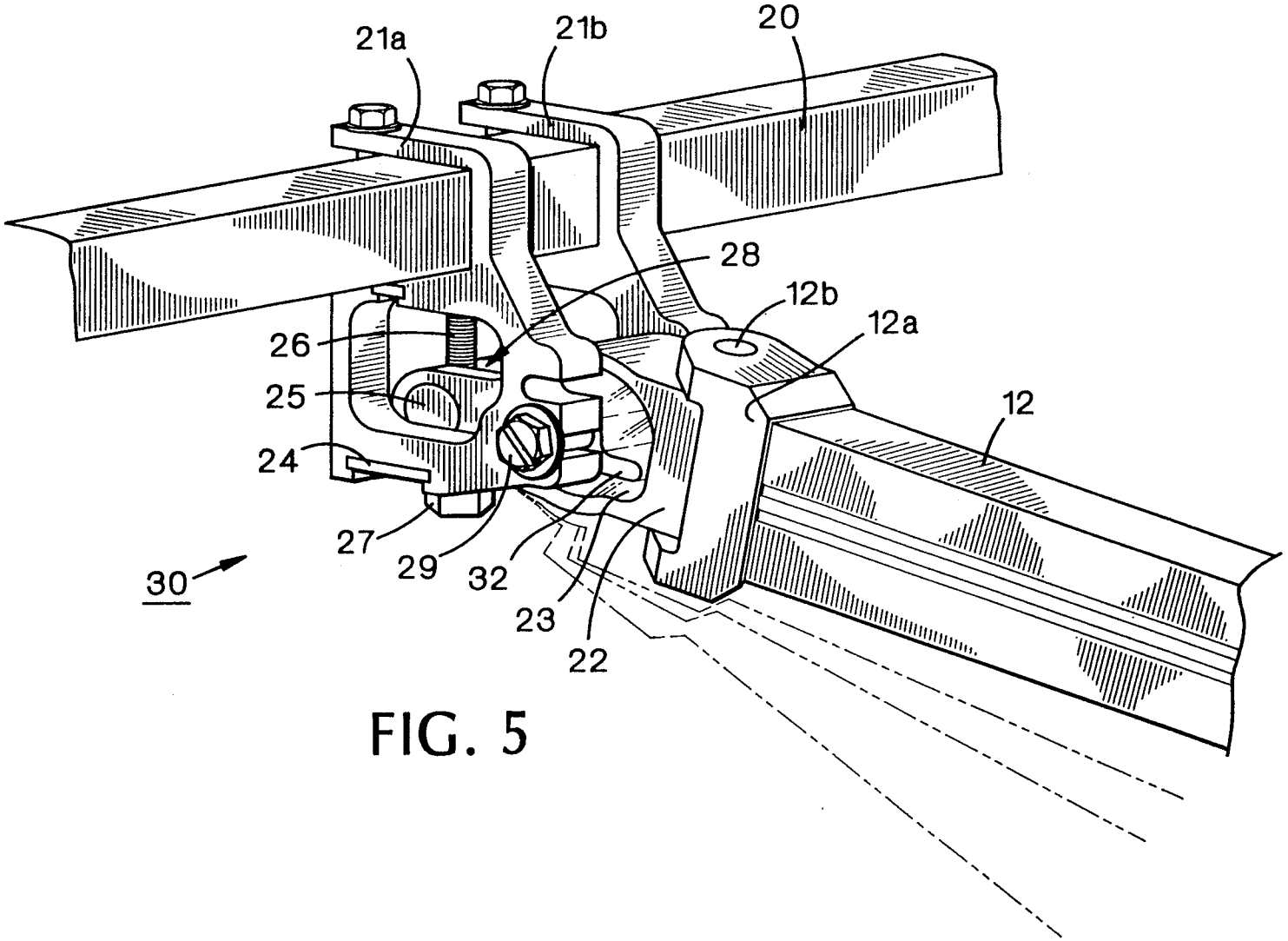
FIG. 5 is a perspective view of another embodiment of a lateral arm bracket according to the present invention.

FIG. 5 illustrates another mounting bracket assembly, according to the present invention, which permits lateral arm 12 to deflect vertically, the bracket assembly being generally indicated by the reference numeral 30. Assembly 30 is shown being attached to a support tube 20 which is secured by conventional brackets (not shown) to a building wall (not shown), the assembly includes two side-by-side shoulder brackets 21*a* and 21*b* which are clamped or otherwise fixed to the support tube and a lateral arm 12 which is pivotally (horizontally) mounted by rod 12*b* to the distal end of a generally hollow housing 22. It will be understood that bracket assembly 30 can be adapted for the use of other means for mounting thereof to a wall.

A compression member 23 of high density polyurethane is disposed in housing 22 between clamp end 12*a* of lateral arm 12 and a horizontal pivot barrel 25 disposed at the proximal end of the housing and journalled therein. Compression member 23 is slightly larger than the space for insertion thereinto in housing 22 so that it expands into and is secured in that space. A bolt 29 supported by brackets 21*a* and 21*b* passes through, in closely fitting relationship therewith, a raised boss formed centrally on an horizontal flange 32 molded in compression member 23, the flange extending through the compression member from side to side and almost the length thereof. Flange 32 evenly transfers force from brackets 21*a* and 21*b* to compression member 23 as vertical force is applied to lateral arm 12, thereby to compress the compression member and provide the required spring action.

A threaded vertical pitch adjusting rod 26 extends through a channel 28 defined in the proximal end of housing 22 and threadingly engages pivot barrel 25. The vertical position of pivot barrel on adjusting rod 26 is set by rotating the adjusting rod by means of a nut 27 fixed to the lower end thereof and bearing against a plate 24 which extends between recesses defined in the lower edges of the shoulder brackets 21*a* and 21*b*. As pivot barrel 25 is raised on adjusting rod 26, lateral arm 12 will pivot downwardly about bolt 29. Likewise, lowering barrel 25 on adjusting rod 26 upwardly pivots lateral arm 12 about bolt 29. Such adjustment sets the equilibrium position of lateral arm 12.

When a downward vertical excessive load is applied to lateral arm 12, compression member 23 compresses, allowing the lateral arm to pivot downwardly about pivot barrel 25 to positions shown in broken lines to shed the load. Likewise, an upward vertical excessive load would cause compression member 23 to compress such that lateral arm 12 would rotate upwardly about pivot barrel 25.

Figure 6:
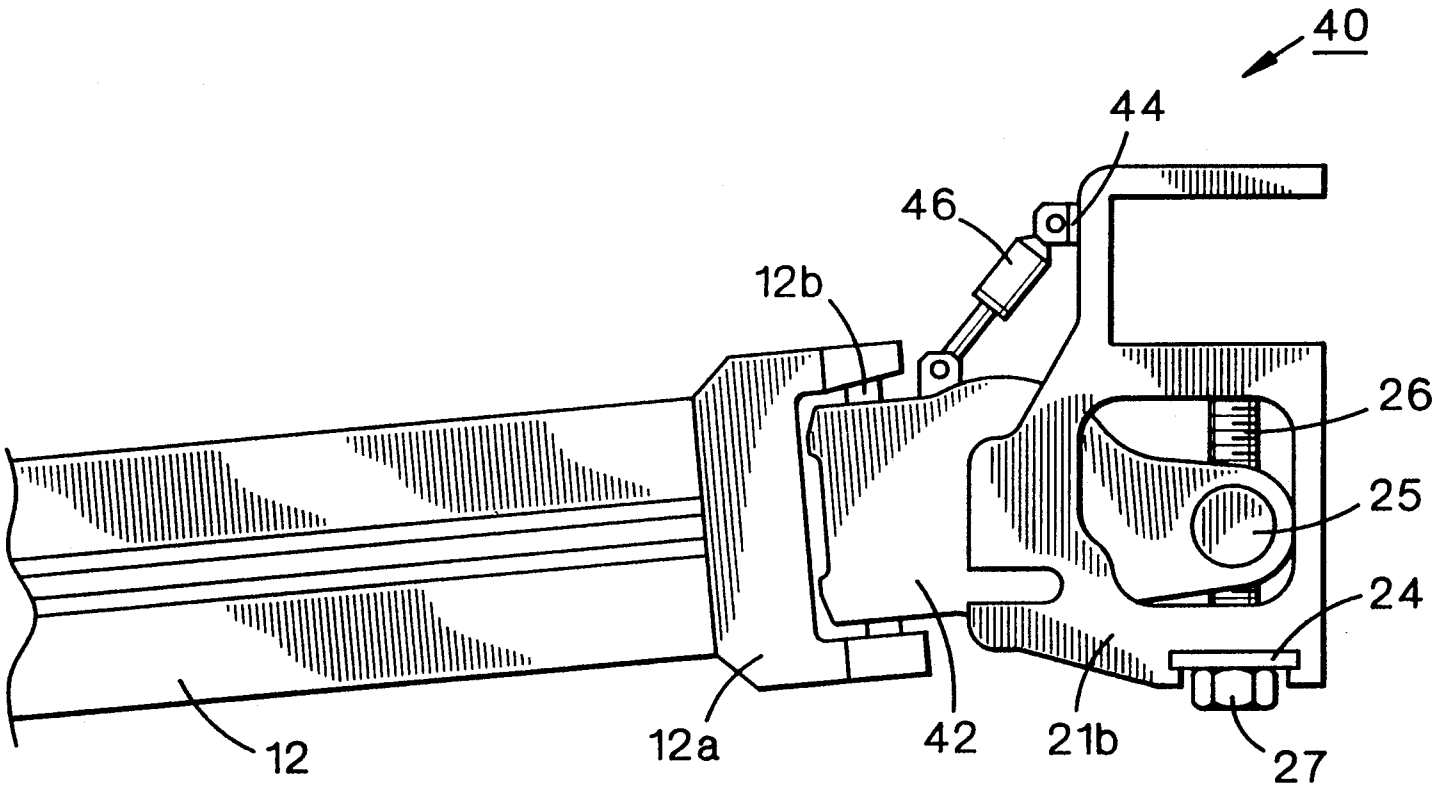
FIGS. 6–8 are side elevational views of additional embodiments of lateral arm brackets according to the present invention.

FIG. 6 illustrates another lateral arm mounting bracket assembly, according to the present invention, the bracket assembly being indicated generally by the reference numeral 40. Bracket assembly 40 is adapted to be mounted to a support tube (not shown), such as support tube 20 on FIG. 5; however, the bracket assembly can be adapted to be mounted directly to a wall or other surface.

The rigid elements of bracket assembly 40 are generally similar to the rigid elements of bracket assembly 30 on FIG. 5, except that hollow housing 22 of bracket assembly 30 has been replaced by a rigid body member 42 having rod 12*b* extending through the distal end thereof and adjusting screw 26 extending through pivot barrel 25 in the proximal end thereof. The angle of lateral arm 12 is adjusted the same as is described above with reference to bracket assembly 30.

Spring action in bracket assembly 40 is provided by a spring-loaded pneumatic cylinder 46, one end of which cylinder is pivotally attached near the distal end of body member 42 and the other end of which is pivotally attached to a plate 44 fixedly attached between shoulder brackets 21*a* and 21*b* (only the latter shown on FIG. 6). Cylinder 46 is of the conventional type in which an internal spring maintains the cylinder, and, therefore, lateral arm 12, in an equilibrium position, and in which cylinder a piston provides damping action. In a similar manner to the above descriptions with respect to FIGS. 1-5, the vertical component of an excessive force on lateral arm 12 will cause the lateral arm to rotate about pivot barrel 25, with cylinder 46 providing the necessary spring action.

Figure 7:
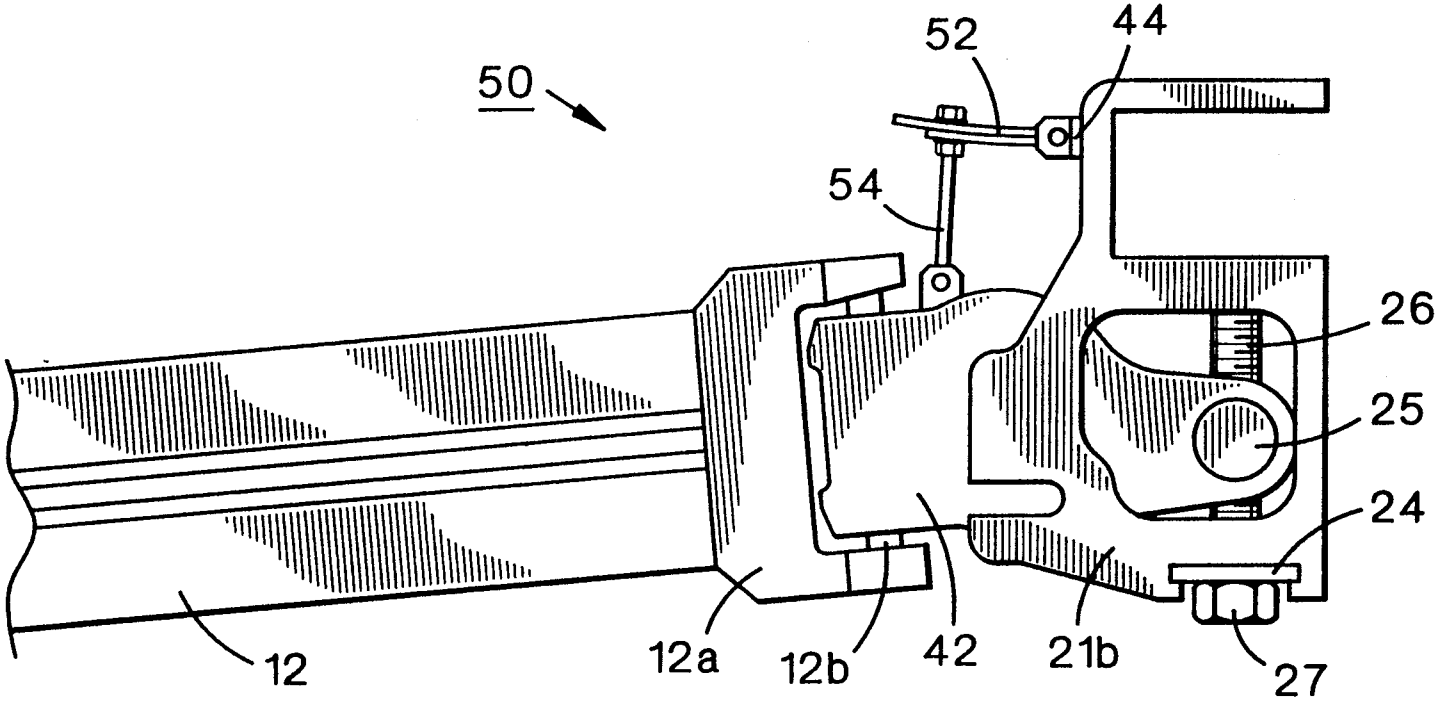

FIG. 7 illustrates another lateral arm mounting bracket assembly, according to the present invention, generally indicated by the reference numeral 50. Mounting bracket 50 is identical to mounting bracket 40 on FIG. 6, except that cylinder 46 of the latter has been replaced by a leaf spring 52. Leaf spring 52 has its proximal end pivotally attached to plate 44 and its distal end attached to the distal end of a rod 54, the proximal end of the latter being attached to body member 42.

Figure 8:
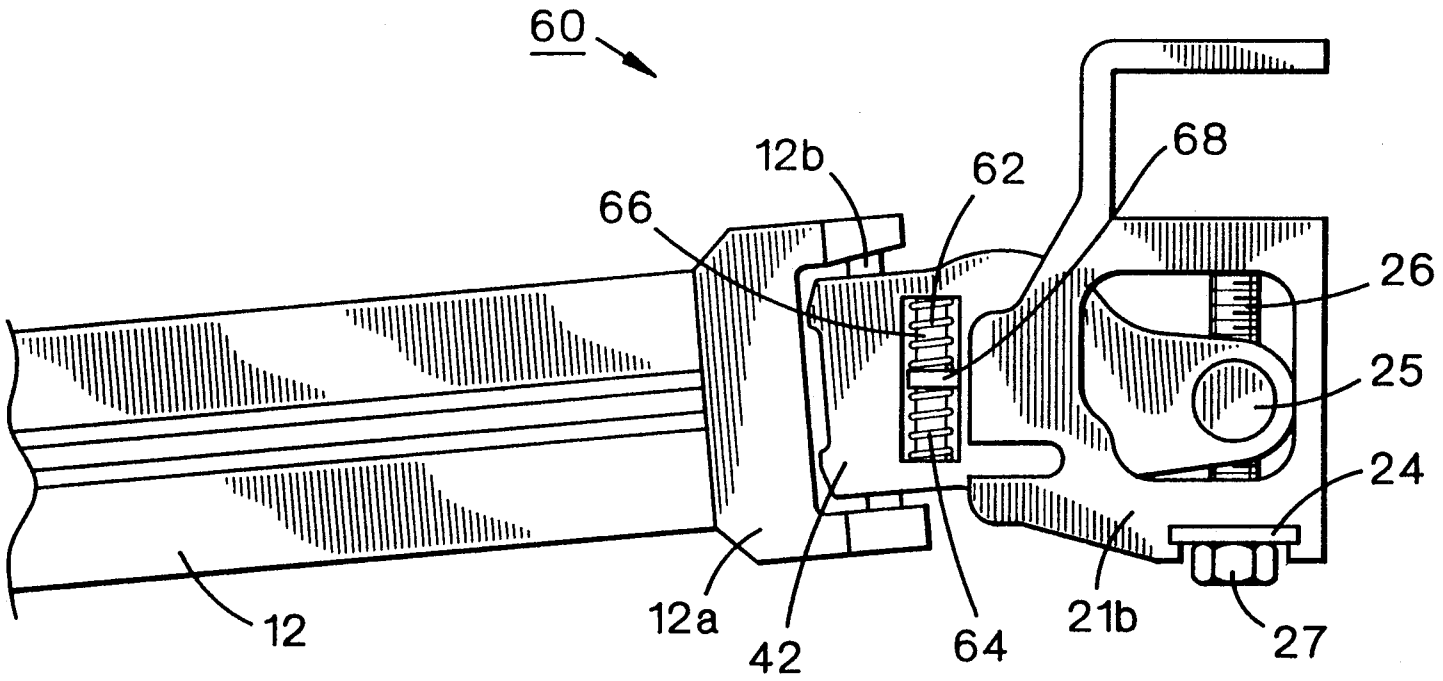

FIG. 8 illustrates another lateral arm support mounting bracket assembly, according to the present invention, generally indicated by the reference number 60. Bracket assembly 60 is similar to bracket assembly 30 on FIG. 5, except that compression member 23 of the latter has been replaced with two coil springs 62 and 64. Coil springs 62 and 64 are disposed over a vertical rod 66 fixedly mounted in the distal end of body member 42. Fixedly attached to shoulder brackets 21*a* and 21*b* (attachment not shown) is a horizontal bar 68 having a U-shaped distal end which fits over vertical rod 66 and which separates coil springs 62 and 64. As lateral arm 12 rotates upwardly or downwardly, bar 68 will cause one of coil springs 62 and 64 to compress and the other to extend, depending on the direction of rotation of the lateral arm, thus providing the necessary spring action.

All patent applications, patents, and other documents cited herein are incorporated in their entirety by reference hereinto.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A bracket assembly for a lateral arm of an awning support system, comprising:

(a) bracket mounting means to mount said bracket assembly to a surface from which said awning extends;

(b) arm mounting means for the vertically pivotal attachment to said bracket mounting means of the proximal end of said lateral arm;

(c) spring means operatively connected between said bracket mounting means and said arm mounting means to normally maintain said lateral arm in an equilibrium position, extending outwardly from said surface, but to allow said lateral arm to rotate vertically from said equilibrium position to absorb the vertical component of an excessive load on said awning and/or to permit said awning to shed the condition producing said excessive load, and then to permit said lateral arm to return to said equilibrium position when said vertical component is no longer present;

(d) said spring means comprises a polymeric compression member, said distal end of said lateral arm comprises a generally hollow housing, and within said housing is closely disposed said polymeric compression member;

(e) said arm mounting means comprises a horizontal pivot barrel disposed through the distal end of said housing and operatively connected to said bracket mounting means; and (f) a shaft secured to said bracket mounting means and extending horizontally through said polymeric compression member to transfer force from said bracket mounting means thereby to compress said polymeric compression member as vertical force is applied to said lateral arm causing said lateral arm to pivot about said pivot barrel.

2. A bracket assembly, as defined in claim 1, wherein said polymeric compression member comprises molded high density polyurethane.

3. A bracket assembly, as defined in claim 1, further comprising a vertical pivot shaft at the proximal end of said housing to permit said lateral arm to fold transversely.

4. A bracket assembly, as defined in claim 1, further comprising a threaded vertical pitch adjustment rod secured against vertical movement with respect to said bracket mounting means, said pitch adjustment rod threadingly engaging said horizontal pivot barrel so as to selectively raise or lower said horizontal pivot barrel to adjust the equilibrium position of said lateral arm.

5. A bracket assembly, as defined in claim 1, further comprising a horizontal flange molded in said polymeric compression member through which said shaft extends, such that said horizontal flange will transfer force from said bracket mounting means thereby to compress said polymeric compression member.

6. A bracket assembly for a lateral arm of an awning support system, comprising:

(a) bracket mounting means to mount said bracket assembly to a surface from which said awning extends;

(b) arm mounting means for the vertically pivotal attachment to said bracket mounting means of the proximal end of said lateral arm;

(c) spring means operatively connected between said bracket mounting means and said arm mounting means to normally maintain said lateral arm in an equilibrium position, extending outwardly from said surface, but to allow said lateral arm to rotate vertically from said equilibrium position to absorb the vertical component of an excessive load on said awning and/or to permit said awning to shed the condition producing said excessive load, and then to permit said lateral arm to return to said equilibrium position when said vertical component is no longer present;

(d) said arm mounting means comprises a horizontal pivot barrel disposed through the distal end of said housing and operatively connected to said bracket mounting means; and (e) a threaded vertical pitch adjustment rod secured against vertical movement with respect to said bracket mounting means, said pitch adjustment rod threadingly engaging said horizontal pivot barrel so as to selectively raise or lower said horizontal pivot barrel to adjust the equilibrium position of said lateral arm.

7. A bracket assembly, as defined in claim 6, wherein said spring means is selected from the group consisting of a polymeric compression member, a coil spring, a leaf spring, and a spring-loaded pneumatic cylinder.

8. A bracket assembly, as defined in claim 7, wherein said polymeric compression member comprises molded high density polyurethane.

9. A bracket assembly, as defined in claim 7, further comprising:

(a) said distal end of said lateral arm comprises a generally hollow housing within said housing is closely disposed said polymeric compression member; and (b) a shaft secured to said bracket mounting means and extending horizontally through said polymeric compression member to transfer force from said bracket mounting means thereby to compress said polymeric compression member as vertical force is applied to said lateral arm causing said lateral arm to pivot about said pivot barrel.

10. A bracket assembly, as defined in claim 9, further comprising a horizontal flange molded in said polymeric compression member through which said shaft extends, such that said horizontal flange will transfer force from said bracket mounting means thereby to compress said polymeric compression member.

11. A bracket assembly, as defined in claim 9, further comprising a vertical pivot shaft at the proximal end of said housing to permit said lateral arm to fold transversely.

* * * * *

UNITED STATES PATENT AND TRADEMARK OFFICE

CERTIFICATE OF CORRECTION

PATENT NO. : 5,273,095
DATED : Dec. 28, 1993
INVENTOR(S) : Lukos

It is certified that error appears in the above-identified patent and that said Letters Patent is hereby corrected as shown below:

In column 6, lines 20-21, "said housing" is changed to --a housing--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*